US006672293B1

(12) United States Patent
Yokoyama et al.

(10) Patent No.: US 6,672,293 B1
(45) Date of Patent: Jan. 6, 2004

(54) EXHAUST GAS RECIRCULATING VALVE DEVICE

(75) Inventors: Hisashi Yokoyama, Tokyo (JP); Yasuhiko Kato, Tokyo (JP); Takeshi Ikai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/937,360

(22) PCT Filed: Jan. 25, 2000

(86) PCT No.: PCT/JP00/00363

§ 371 (c)(1),
(2), (4) Date: Sep. 25, 2001

(87) PCT Pub. No.: WO01/55579

PCT Pub. Date: Aug. 2, 2001

(51) Int. Cl.[7] ..... F02B 47/08
(52) U.S. Cl. ..... 123/568.21; 251/129.11
(58) Field of Search ..... 123/568.21, 568.24, 123/568.23; 251/129.11; 277/427

(56) References Cited

U.S. PATENT DOCUMENTS

| | | | | |
|---|---|---|---|---|
| 4,782,811 A | | 11/1988 | Hewette et al. | 123/571 |
| 5,351,935 A | | 10/1994 | Miyoshi et al. | |
| 5,669,364 A | | 9/1997 | Everingham | 123/568 |
| 5,769,390 A | | 6/1998 | Ando | |
| 6,227,183 B1 | | 5/2001 | Miyoshi et al. | 123/568.23 |
| 6,378,838 B1 | * | 4/2002 | Brundisini | 251/129.04 |
| 6,453,891 B2 | * | 9/2002 | Kato et al. | 123/568.24 |

FOREIGN PATENT DOCUMENTS

| | | | |
|---|---|---|---|
| EP | 0 810 361 A1 | 12/1997 | |
| EP | 1 156 246 A1 | 11/2001 | |
| JP | 57-92042 | 11/1955 | |
| JP | 5-106520 | 4/1993 | F02M/25/07 |
| JP | 6-18966 | 3/1994 | F16K/1/48 |
| JP | 8-4932 | 1/1996 | F16K/31/04 |
| JP | 8-44432 | 2/1996 | G05D/7/06 |
| JP | 8-68324 | 3/1996 | F01P/5/10 |

* cited by examiner

*Primary Examiner*—Mahmoud Gimie
(74) *Attorney, Agent, or Firm*—Sughrue Mion, PLLC

(57) ABSTRACT

The exhaust gas recirculation valve device of the present invention is provided with a motor main body 20 which drives a valve 8 by a valve rod 6 in direction of opening or closing, and a motor holder 21 which covers the lower opening of the motor main body 20. A circular groove 50 is formed on one of the upper section of the motor holder 21 and the lower opening of the motor main body 20 and a protrusion 60 which fits into the circular groove 50 is formed on the other of the upper section of the motor holder 21 and the lower opening of the motor main body 20. A liquid sealant layer 70 is disposed between upper face 61 which is the top of the protrusion and the lower face 50*a* which is the bottom of the circular groove 50 facing the upper face 61.

7 Claims, 5 Drawing Sheets

EXHAUST GAS RECIRCULATING VALVE DEVICE

This application is the national phase under 35 U.S.C. §371 of PCT International Application No. PCT/JP00/00363 which has an International filing date of Jan. 25, 2000, which designated the United States of America and was not published in English.

FIELD OF THE INVENTION

The present invention relates to an exhaust gas recirculation valve device disposed in an exhaust gas recirculation passage of an internal combustion engine for example of an automobile.

BACKGROUND TO THE INVENTION

FIG. 1 is a cross sectional figure showing the internal structure of a conventional exhaust gas recirculation valve device. In the figure, the valve housing 1 has an inlet port 2 communicating with an exhaust system (not shown) of an engine which is an internal combustion engine, an outlet port 3 which communicates with an air intake system (not shown) of the engine and a passage 4 interposed between the outlet port 3 and the inlet port 2. A valve seat 5 is press fitted into the passage 4. 6 is a valve rod passing through a bushing 7. A valve 8 is mounted on the lower end of the valve rod 6 to separate or abut with the valve seat 5. 9 is a holder to prevent deposition of substances in the bushing 7. 10 is a spring holder which is pushed upwardly by a coil spring 11. A through hole 12 is formed in the central section of the spring holder 11. The tip 6*a* of the valve rod 6 is fixed by caulking through the through hole 12. The valve rod 6 and the spring holder 10 are integrated by caulking and the valve 8 mounted on the lower section of the valve rod 6 is normally pushed in a closed position with respect to the valve seat 5 by the coil spring 11. 13 is a cooling water passage cooling the motor to be described below and the valve body.

20 is a stepping motor main body functioning as a stator assembly with respect to the rotor section to be discussed below. A motor holder 21 is fixed to the lower section of the stepping motor 20 by a clamp screw 23 through an O-ring 22 in order to prevent the entry of water into the stepping motor main body 20. A motor brush 25 is disposed to retain the motor shaft 24 in a central opening of the motor holder 21. The lower section of the motor shaft 24 is fixed by caulking to the spring holder 26 and a joint 27. 28 is a spring which is disposed between the motor holder 21 and the spring holder 26 and which pushes the motor shaft 24 in a direction opening the valve.

30 are bobbins which are wound coils 31. 32 and 33 are yokes. A magnetic path is formed through the outer periphery of the yokes 32 and 33. 34 are terminals which are electrically connected to coils 31. The terminals 34 and a motor housing 35 form a connector. 36 is a plate which shields the two coil sections magnetically. 37 is a plate preventing resin from flowing into the coil inner section when the motor housing 35 is exterior molded.

40 is a magnet. 41 is a rotor retaining a magnet. The magnet 41 has a threaded section 41*a* threadably attached to a threaded section 24*a* of the motor shaft 24 on an inner periphery and an axial stopper 41*b* of the motor shaft 24. 42 are bearings mounted on both ends of the rotor 41. 43 is a stopper pin press fitted to the motor shaft 24.

This type of stepping motor main body 20 maintains a waterproof structure due to the motor holder 21 fixed to the lower section of the stepping motor main body 20 and is mounted on the top section of the valve housing 1 so that the axial centers are aligned by a mounting screw 44.

The operation will be described below.

Firstly, when the engine is started and the valve is completely closed, the rotor 41 which contains a magnet 40 rotates in a stepwise manner in a direction of valve opening due to a pulsed voltage sent from the control unit (not shown) to the terminals 34 during the valve opening operation. The stepwise rotation is converted into linear motion by the threaded section 41*a* of the rotor 41 and the threaded section 24*a* of the motor shaft 24 and the motor shaft 24 displaces in a direction of valve opening (downwardly). As the displacement continues, at the moment when the upper face of the tip 6*a* of the valve rod 6 near the valve housing 1 abuts with the lower face of the motor shaft 24 near the motor housing 35, the valve rod 6 is depressed by the drive force of the motor shaft 24 against the pushing upward force of the coil spring 11. Also the valve 8 which is mounted on the lower section of the valve rod 6 is lowered and opens with respect to the valve seat 5 and the inlet port 2 and the outlet port 3 are connected by the passage 4.

During the valve closure operation, the rotor 41 which contains a magnet 40 rotates in a stepwise manner in a direction of valve closure due to a pulsed voltage sent from the control unit (not shown) to the terminals 34 in an operation which is the opposite of the above. The motor shaft 24 displaces in a direction of valve closure (upwardly) due to the rotation. In addition to the rotation, the valve rod 6 is raised by the upward pushing force of the coil spring 11 and the valve 8 covers the opening of the valve seat 5.

The waterproofing structure of the stepping motor main body 20 in this type of exhaust gas recirculation valve device is realized by pressing a motor holder 21 by an O-ring 22 onto the lower section of the stepping motor main body 20 and by covering and closing the space between the stepping motor main body 20 and the motor holder 21 with a clamp screw 23 as the O-ring is compressed.

However the unit price of O-rings is relatively high and thus in order to reduce the overall cost of the exhaust gas recirculation valve device, it is required to maintain the waterproofing structure of the stepping motor main body 20 without using an O-ring 22.

The present invention is proposed to solve the above problems and has the object of providing an exhaust gas recirculation valve device which maintains a waterproof structure in the stepping motor main body 20 without using an O-ring 22.

DISCLOSURE OF THE INVENTION

The exhaust gas recirculation valve device according to the present invention is provided with a motor main body which has a motor driving a valve with a valve rod in an opening or a closing direction, and a motor holder which covers the lower opening of the motor main body. One of the lower opening of the motor main body and the upper section of the motor holder is formed a circular groove and the other of the lower opening of the motor main body and the upper section of the motor holder is formed in a protrusion which fits in the circular groove. A liquid sealant is applied between the top of the protrusion and the bottom of the circular groove facing the top of the protrusion. In this way in contrast to the prior art, it is not necessary to use an O-ring which has a relatively high unit price and thus it is possible to reduce the overall manufacturing costs of the exhaust gas recirculation valve device. Furthermore it is possible to ensure maintenance of the waterproofing structure of the motor main body without a threaded stopper since a liquid sealant is used which can be easily adapted to the surface structure of the section to which the sealant is applied.

The present invention is provided with a circular groove which has a bottom and an innermost circular periphery which is adjacent to the bottom and a protrusion which has a top and an innermost circular periphery which is adjacent to the top. The present invention is adapted so that the top of the protrusion and the bottom of the circular groove are placed in contact through the liquid sealant with the innermost periphery of the protrusion fitted to the innermost periphery of the circular groove. Thus excess liquid sealant which is interposed between the bottom of the circular groove and the top of the protrusion is prevented from flowing into the motor main body by a fitted section comprising the circular groove and the protrusion. Therefore it is possible to prevent unexpected defects in motor operation due to the liquid sealant.

Since the present invention fixes a section of the outermost periphery of the circular groove by caulking to the outermost periphery of the protrusion, it is possible to fix the motor holder and the motor main body while keeping the space for leading the excess liquid sealant and thus ensure a waterproofing structure in the motor main body.

Since the present invention is adapted to make a clearance between the outermost periphery of the circular groove and the outermost periphery of the protrusion facing the outermost periphery greater than the clearance between the innermost periphery of a circular groove and the innermost periphery of the protrusion. In this way, it is possible to form a space to store excess liquid sealant between the respective outermost peripheries of the circular groove and the protrusion.

The present invention is adopted to form a hollow to store the excess liquid sealant on the top of the outermost periphery of the protrusion. In such a way, it is possible to effectively store the excess liquid sealant in the hollow.

The present invention is adopted to make a clearance between the bottom of the circular groove and the top of the protrusion facing the bottom of the circular groove greater than the clearance between periphery of the protrusion. In such a way, it is possible to form a space to store the excess liquid sealant between the respective outermost peripheries of the circular groove and the protrusion.

The present invention is adapted to form a hollow to store excess liquid sealant in the bottom of the outermost periphery of the circular groove. In such a way, it is possible to effectively store excess liquid sealant in the hollow.

PREFERRED EMBODIMENTS OF THE INVENTION

In order to describe the invention in greater detail, the preferred embodiments will be outlined below with reference to the accompanying figures.

Embodiment 1

Figure 1:
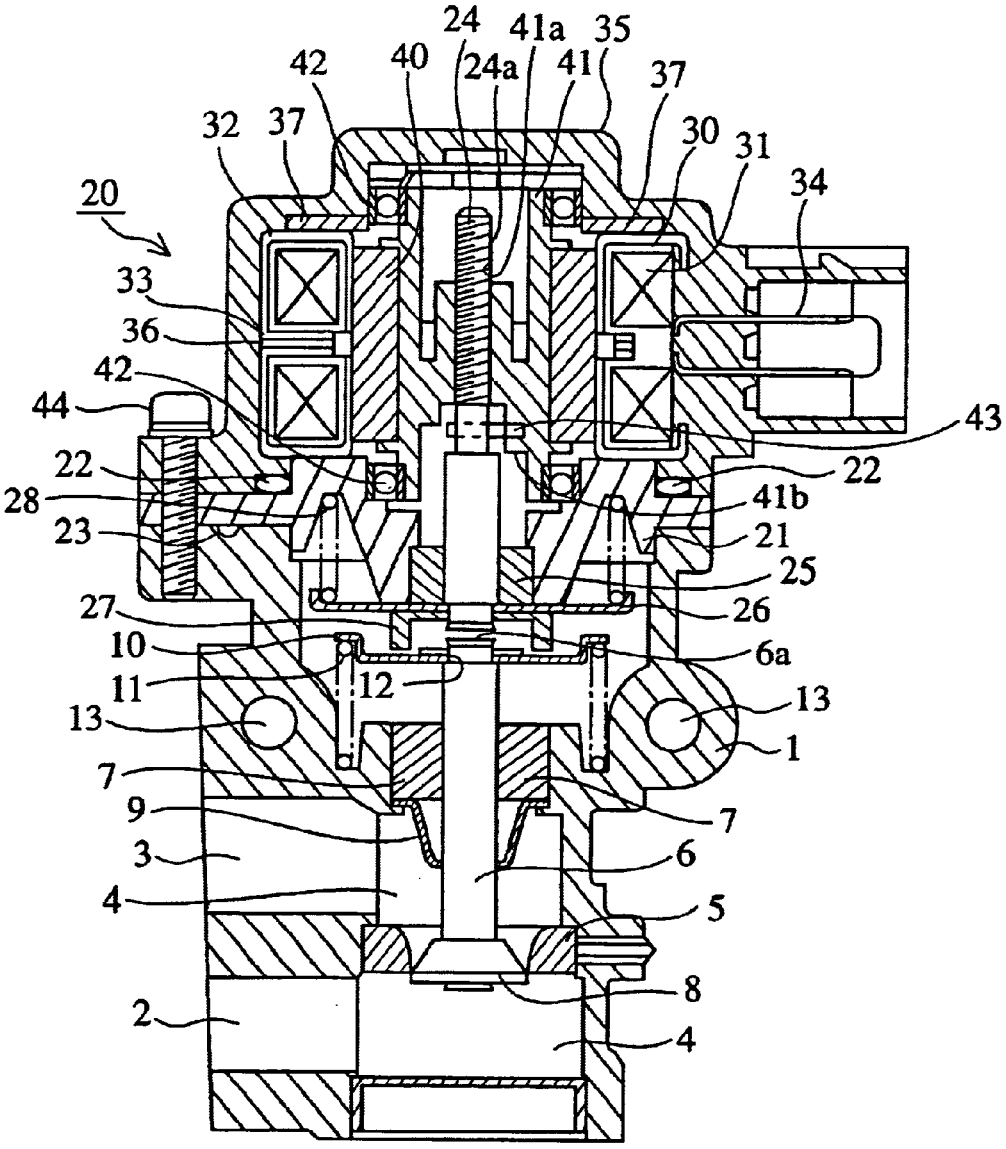
FIG.1 PRIOR ART
FIG. 1 is a cross sectional view showing the interior structure of a conventional exhaust gas recirculation valve device.
Figure 2:
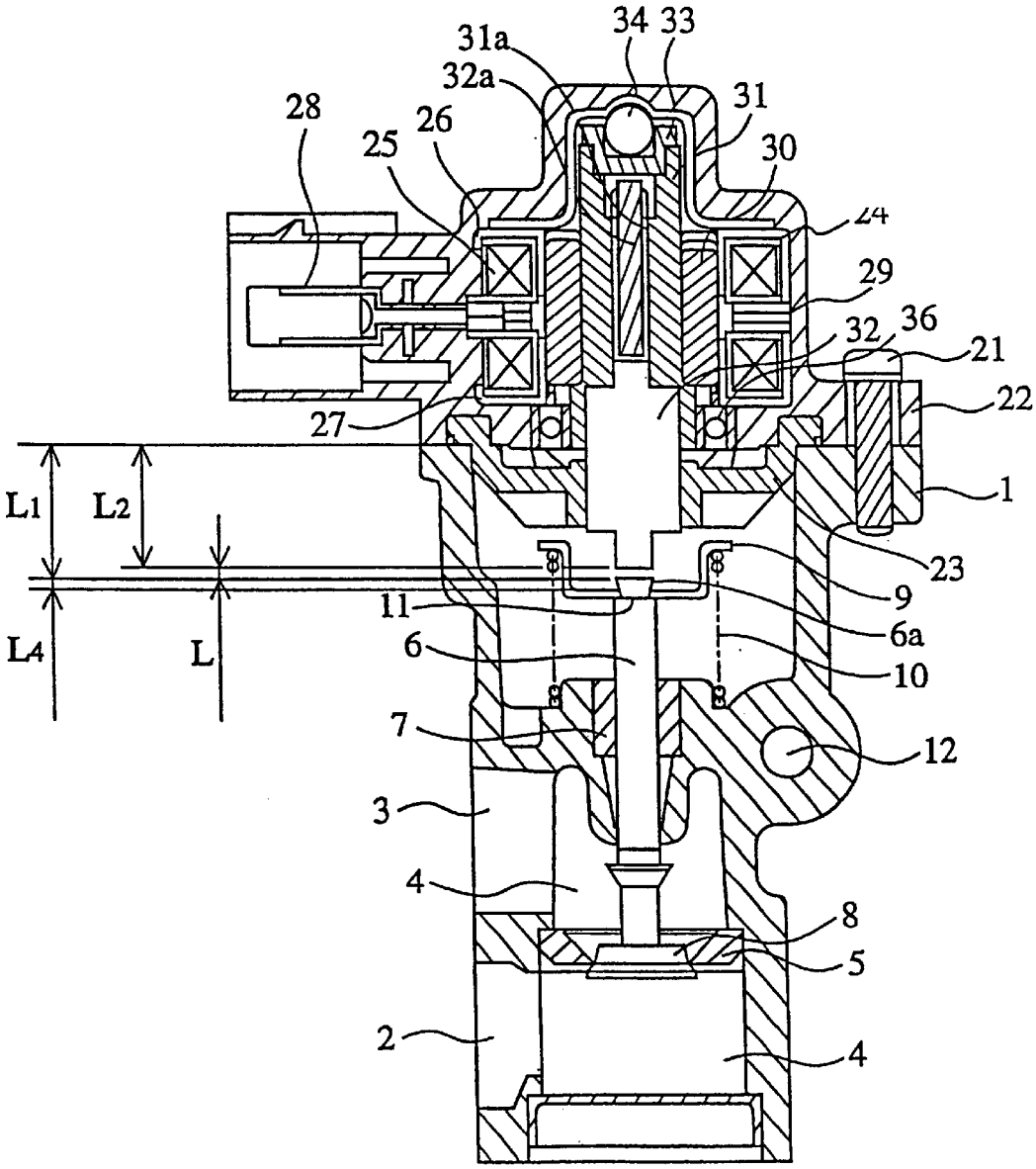
FIG. 2 is a cross sectional view showing the interior structure of an exhaust gas recirculation valve device according to a first embodiment of the present invention.
Figure 3A:
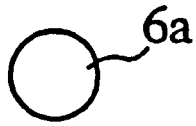
FIG. 3 is a cross sectional view showing an enlargement of a waterproofing section A of an exhaust gas recirculation valve device as shown in FIG. 2.
Figure 3B:
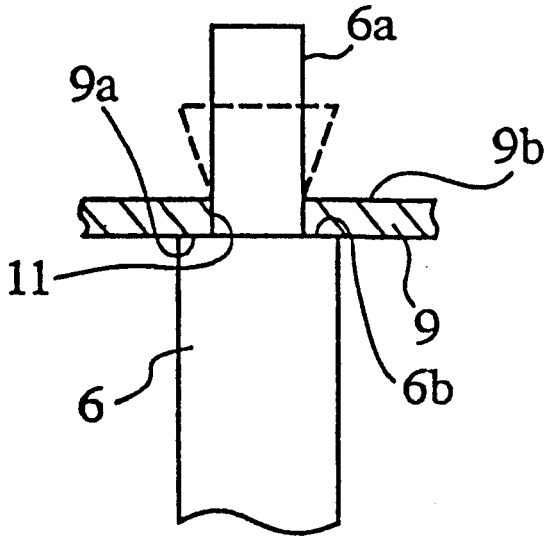
Figure 4A:
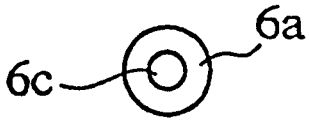
FIG. 4 is a perspective view along the line B—B in FIG. 2.
Figure 4B:
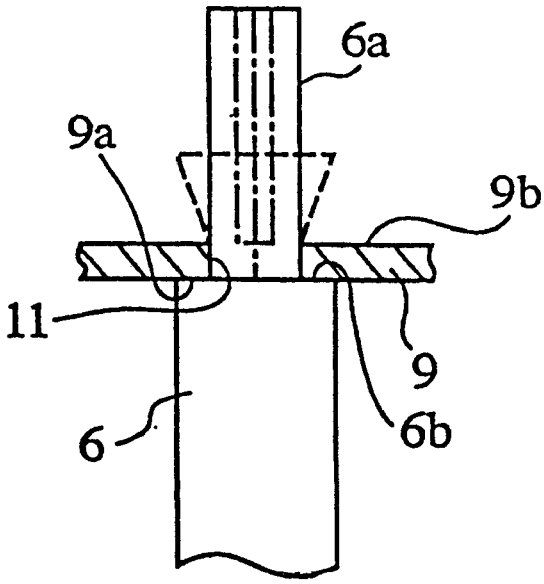
Figure 5:
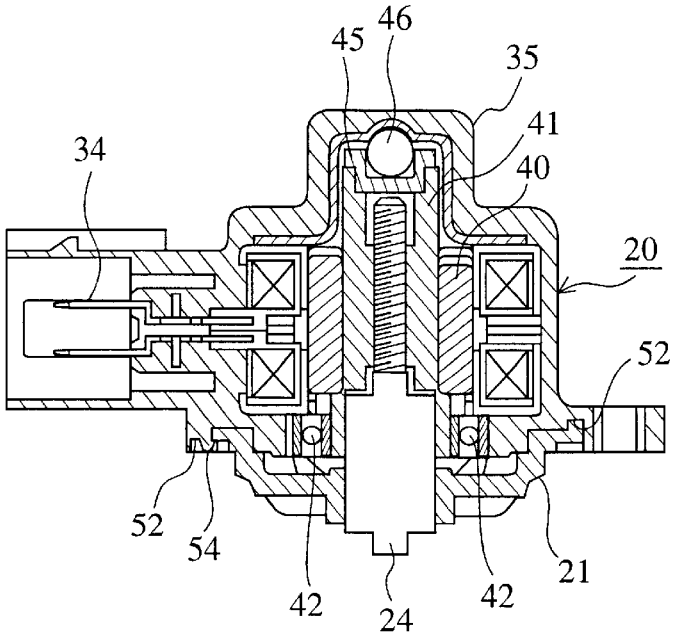
FIG. 5 is a cross sectional view along the line C—C in FIG. 4.
Figure 3:
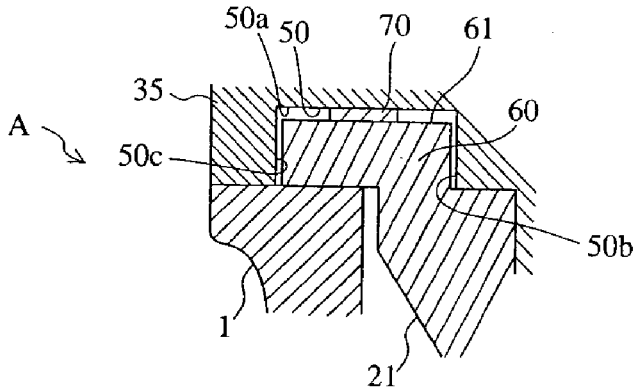
Figure 4:
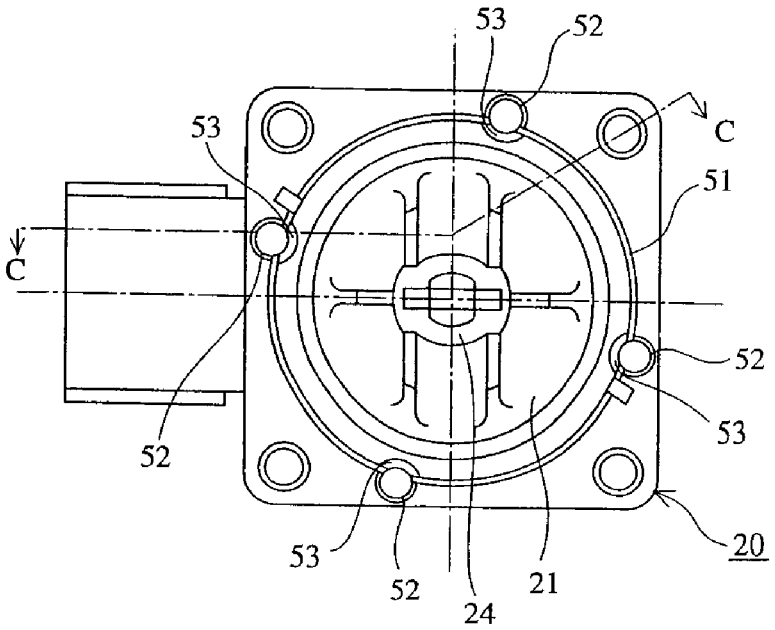

FIG. 2 is a cross sectional view showing the interior structure of an exhaust gas recirculation valve device according to a first embodiment of the present invention. FIG. 3 is a cross sectional view showing an enlargement of a waterproofing section A of an exhaust gas recirculation valve device as shown in FIG. 2. FIG. 4 is a perspective view along the line B—B in FIG. 2. FIG. 5 is a cross sectional view along the line C—C in FIG. 4. Those components of the first embodiment of the present invention which are the same as those of the conventional exhaust gas recirculation valve device as shown in FIG. 1 are denoted by the same reference numerals and further description will be omitted. In FIG. 2, 45 is a shaft bushing mounted on the top of the rotor 41 and 46 is a bearing for the shaft bushing 45.

In embodiment 1, the waterproofing section A shown in FIG. 2 is schematically formed by a circular groove 50 formed with a rectangular cross section on a lower section of the motor housing 35 as shown in FIG. 3, a protrusion 60 which is rectangular in cross section and which is formed on an upper section of the motor holder 21 to fit into the circular groove 50 and a liquid sealant layer 70 interposed between the upper face forming the top of the protrusion 60 and the lower face 50*a* forming the bottom of the circular groove 50. 50*b* and 50*c* denote the inner peripheral face and the outer peripheral face of the circular groove 50.

As shown in FIG. 4 and FIG. 5, an outer groove 51 which is concentric with the circular groove 50 is formed on the outer side of the circular groove 50. A plurality of caulking holes 52 (in the figure there are four) are formed at approximately equally spaced intervals on the outer groove 51. Wall faces of the caulking holes 52 which are near the circular groove 50 and the protrusion 60 are deformed in a direction covering a section of the protrusion 60 by heat caulking or mechanical caulking. This caulking allows secure fixing of the motor holder 21 to the lower section of the motor housing 35.

The liquid sealant forming a liquid sealant layer 70 is called a liquid packing or a liquid gasket. The liquid sealant is applied in liquid form and solidifies in contact with air after application. For example, it is preferable to use a sealant such as silicon. It is preferred that the liquid sealant is uniformly applied in a fixed amount for example from the tip of a robot manipulator to one or both of the upper surface 61 of the protrusion 60 and the lower face 50*a* of the circular groove 50. Therefore even if the fit of the seal surface between the upper face 61 of the protrusion 60 and the lower face 50*a* of the circular groove 50 is disturbed, the liquid sealant is adapted to the fit and thus can maintain a flexible waterproof structure with respect to the surface structure of the sealed face.

As shown above, the conventional exhaust gas recirculation valve device shown in FIG. 1 uses an O-ring 22 to maintain the waterproof structure. Even when the O-ring 22 is compressed, a space must be provided in a considerably compressive direction. However in embodiment 1, a slight clearance is sufficient to allow sealing with a liquid sealant layer 70 which thus allows the overall device size to be downscaled.

This type of liquid sealant layer 70 is extremely thin in comparison with an O-ring 22 and can be adapted to the shape of the sealant face. Thus it is possible to form an outer shape of the protrusion 60 which corresponds to the inner shape of the circular groove 50. Furthermore the molding of the motor holder 21 and the motor housing 35 is simplified and the design operation is facilitated.

In embodiment 1, a circular groove is formed at the motor housing 35 and a protrusion is formed at the motor holder 21. However it is possible to form the circular groove at the motor holder 21 and the protrusion at the motor housing 35.

The liquid sealant used in embodiment 1 was a liquid flowing when applied and was hardened when contacted with air. So the possibility of malfunction of the motor drive exists if the liquid sealant enters the rotating section in the motor housing 35. Embodiment 2 and embodiment 3 below relate to improvements to prevent the unexpected generation of this type of problem.

Embodiment 2

Figure 6:
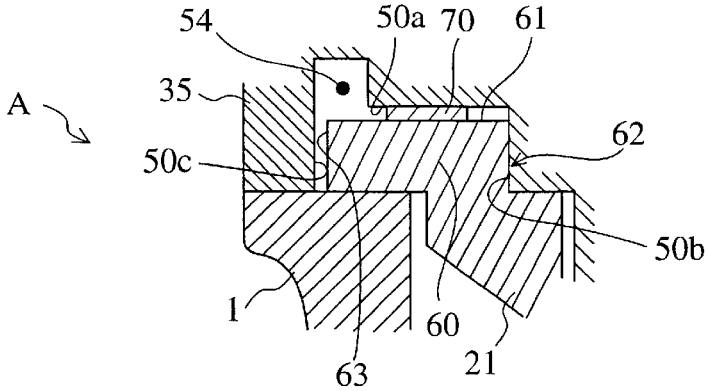
FIG. 6 is a cross sectional view showing a waterproofing section A of an exhaust gas recirculation valve device according to a second embodiment of the present invention.

FIG. 6 is a cross sectional view showing a waterproofing section A of an exhaust gas recirculation valve device according to a second embodiment of the present invention.

The characteristic of embodiment 2 is related to the arrangement below. An inner peripheral face 62 which is the inner peripheral section of the protrusion 60 of the motor holder 21 is fitted into the inner peripheral face 50*b* which is the inner peripheral section of the circular groove 50 of the motor housing 35. A liquid sealant layer 70 is interposed between the upper face 61 next to the inner peripheral face 62 of the protrusion 60 and the lower face 50*a* next to the inner peripheral face 50*b* of the circular groove 50. A clearance between the outer peripheral face 63 which is the outermost peripheral section of the protrusion 60 and the outer peripheral face 50*c* which is the outermost peripheral section of the circular groove 50 is set to be greater than the clearance of the inner peripheral face 62 of the protrusion 60 and the inner peripheral face 50*b* of the circular groove 50. Furthermore an hollow 54 storing excess liquid sealant is provided on the lower face 50*a* on the outermost side of the circular groove 50.

In embodiment 2, the inner peripheral face 62 which is the inner peripheral section of the protrusion 60 of the motor holder 21 is fitted into the inner peripheral face 50*b* which is the inner peripheral section of the circular groove 50 of the motor housing 35. The clearance of both inner peripheral faces is set to almost zero which prevents seepage of excess liquid sealant comprising the liquid sealant layer 70 into the rotating section of the motor housing 35. The clearance between the outer peripheral face 50*c* which is the outermost peripheral section of the circular groove 50 and the outer peripheral face 63 which is the outermost peripheral section of the protrusion 60 is larger than the clearance on the inner side. Thus it is possible to store excess liquid sealant comprising the liquid sealant layer 70 by the provision of an hollow 54. Furthermore it is possible to prevent seepage of the liquid sealant out of the motor housing 35.

Although the upper face 61 of the. protrusion 60 is parallel to the lower face 50*a* of the circular groove 50 in embodiment 2, the upper face 61 may be inclined so that the distance separating the lower face 50*a* of the circular groove 50 from the inner peripheral face 62 to the outer peripheral face 63 gradually increases. The clearance between the upper face 61 and the bottom face 50*a* may be formed in a tapering shape. This allows effective seepage of excess liquid sealant out of the motor housing 35. The use of this type of structure for the upper face 61 in embodiment 2, in particular the use of the structure having an hollow 54 in the circular groove 50 allows excess liquid sealant to be effectively distanced from the entry passage into the motor housing 35. Thus it is possible to ensure prevention of seepage of the liquid sealant into the motor housing 35.

Embodiment 3

Figure 7:
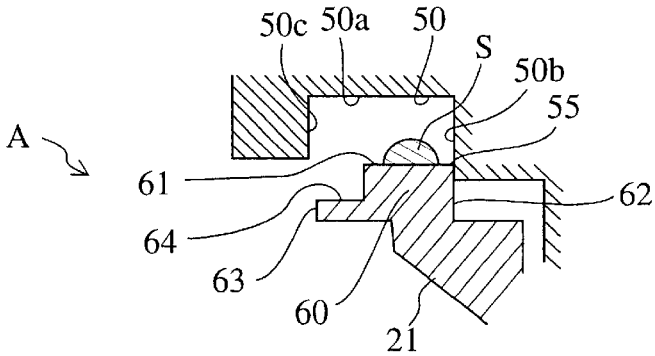
FIG. 7 is a cross sectional view showing a waterproofing section A of an exhaust gas recirculation valve device according to a third embodiment of the present invention.

FIG. 7 is a cross sectional view showing a waterproofing section A of an exhaust gas recirculation valve device according to a third embodiment of the present invention.

The characteristic of embodiment 3 lies in the provision of a hollow 64 forming a hollowed section on the outer peripheral face 63 and the upper face 61 of the protrusion 60. The hollow 64 ensures a space storing excess liquid sealant in the circular groove 50. In comparison with the structure as shown in FIG. 3 in which for example a hollow 64 is not formed on the protrusion 60, when the protrusion 60 is fitted into the circular groove 50, the provision of the hollow 64 firstly allows abutment of the ridge line 55 of the inner peripheral face 50*b* and the upper face 61 with the inner peripheral face 50*b* of the circular groove 50. This takes place before the lower face 50*a* of the circular groove 50 abuts with the upper face 61 of the protrusion 60 and liquid sealant S in introduced between both faces. Thus it is possible to shield the entry passage into the motor housing 35 from the liquid sealant S. Thereafter even when the liquid sealant S is introduced between both faces, it is possible to ensure prevention of seepage of the liquid sealant S into the motor housing 35 by allowing the excess sealant to be led to the space between the hollow 64 of the protrusion 60 and the circular groove 50.

Embodiment 4

Figure 8:
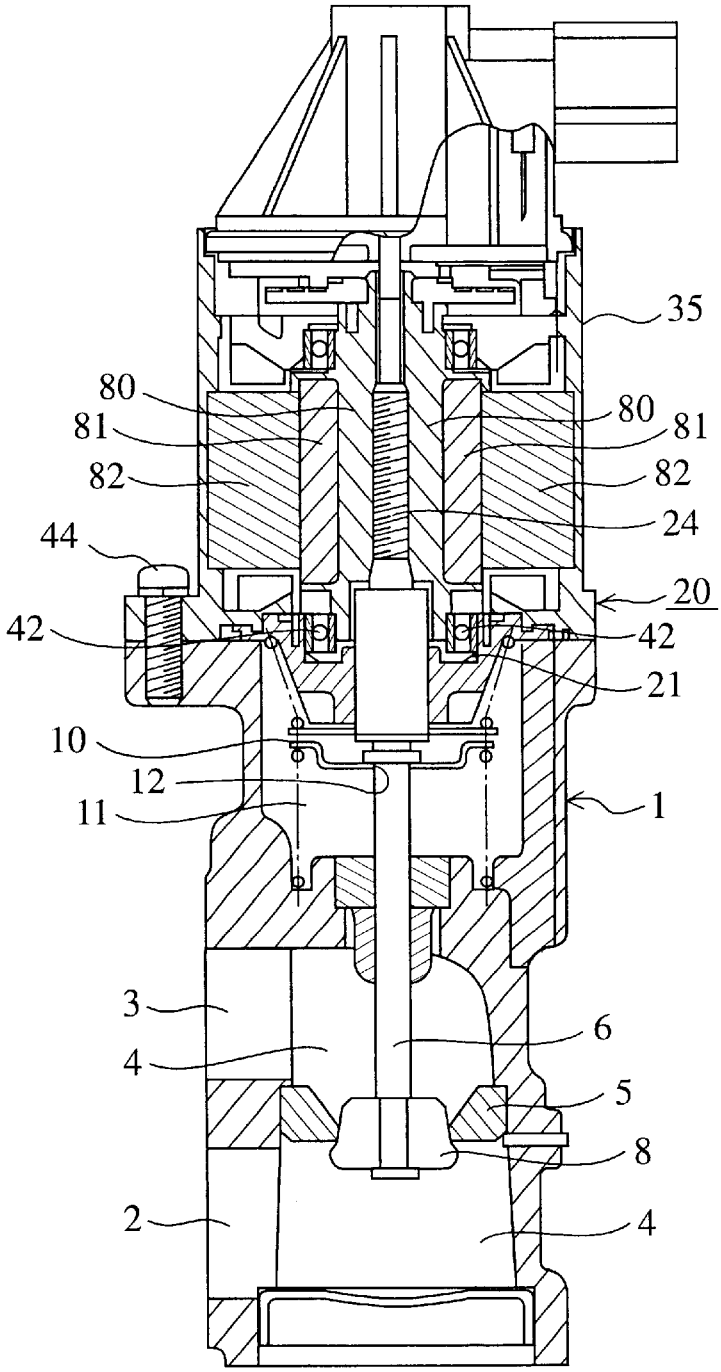
FIG. 8 is a cross sectional view of the interior structure of an exhaust gas recirculation valve device according to a fourth embodiment of the present invention.
Figure 2:
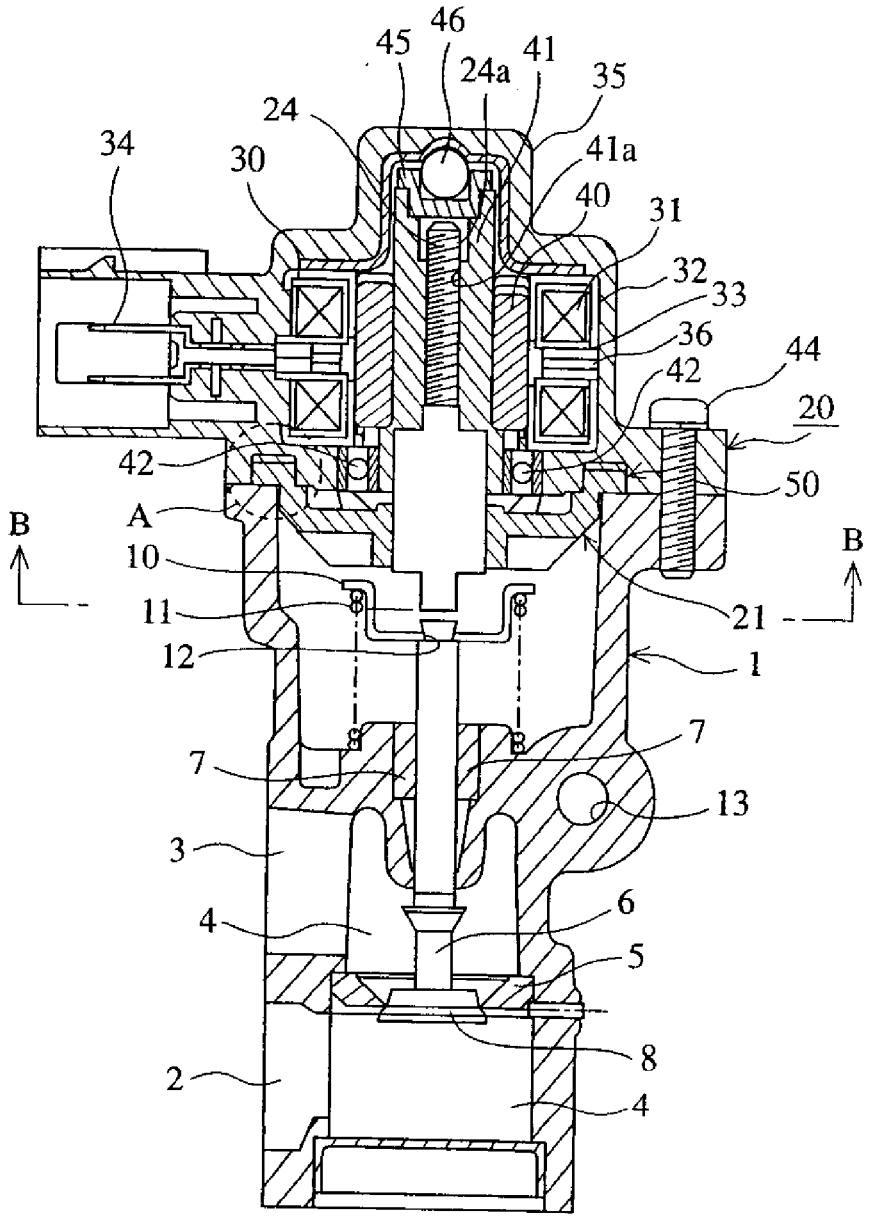

FIG. 8 is a cross sectional view of the interior structure of an exhaust gas recirculation valve device according to a fourth embodiment of the present invention.

In contrast to embodiments 1, 2 and 3 in which a stepping motor is used as a motor in the motor main body 20, embodiment 4 is characterized by the use of a DC motor. Those components of embodiment 4 which are common to components of the exhaust gas recirculation valve device shown in FIG. 2 and the conventional exhaust gas recirculation valve device as shown in FIG. 1 are denoted by the same reference numerals and additional description will be omitted. In FIG. 8, 80 is a rotor, 81 is a magnet, and 82 is a yoke.

In embodiment 4, there is no necessity to use an O-ring 22 shown in the conventional example due to the use of a liquid sealant in the waterproof structure of the motor main body 20. This allows reductions in manufacturing costs and reductions in component numbers. Furthermore since the contact distance of the motor holder 21 and the motor housing 35 is reduced in comparison with the prior art, it is possible to downsize the overall size of the exhaust gas recirculation valve device.

In embodiment 4, as shown in FIG. 3, FIG. 6 and FIG. 7, it is possible to ensure maintenance of the waterproofing structure of the motor main body 20 by provision of a space for leading excess liquid sealant at a position removed from the entry passage into the motor housing 35.

Industrial Application

As shown above, in contrast to the convention example, the exhaust gas recirculation valve device of the present invention avoids the necessity for use of an O-ring which has a high unit price. Thus the overall manufacturing costs of the exhaust gas recirculation valve device can be reduced. Furthermore since a liquid sealant which can be adapted to the surface shape of the applied section is used, it is possible to maintain a waterproof structure in the motor main body without threaded fixing. It is possible to prevent entry of excess liquid sealant into the motor main body by making a space for leading liquid sealant between the protrusion which fits in the circular groove and the circular groove between the motor main body and the motor holder.

What is claimed is:

1. An exhaust gas recirculation valve device provided with:

a motor main body which has a motor which drives a valve with a valve rod in an opening or a closing direction, and a motor holder which covers a lower opening of the motor main body, one of the lower opening of the motor main body and an upper section of the motor holder are formed as a circular groove and the other of the lower opening of the motor main body and the upper section of the motor holder is formed in a protrusion which fits in the circular groove, liquid sealant is applied between the top of the protrusion and the bottom of the circular groove facing the top of the protrusion.

2. An exhaust gas recirculation valve device as defined in claim 1 wherein:

the circular groove has a bottom and an innermost circular periphery which is adjacent to the bottom, and the protrusion has a top and an innermost circular periphery which is adjacent to the top, the top of the protrusion and the bottom of the circular groove are placed in contact through the liquid sealant with the innermost periphery of the protrusion fitted to the innermost periphery of the circular groove.

3. An exhaust gas recirculation valve device as defined in claim 2 wherein:

a section of the outermost periphery of the circular groove is fixed by caulking to the outermost periphery of the protrusion.

4. An exhaust gas recirculation valve device as defined in claim 3 wherein:

a clearance between the outermost periphery of the circular groove and the outermost periphery of the protrusion facing the outermost periphery of the circular groove is greater than the clearance between the innermost periphery of the circular groove and the innermost periphery of the protrusion.

5. An exhaust gas recirculation valve device as defined in claim 3 wherein:

a hollowed section is formed to store excess liquid sealant on the top of the outermost periphery of the protrusion.

6. An exhaust gas recirculation valve device as defined in claim 3 wherein:

a clearance between the bottom of the circular groove and the top of the protrusion facing the bottom of the circular groove is greater than the clearance between the innermost periphery of the circular groove and the innermost periphery of the protrusion.

7. All exhaust gas recirculation valve device as defined in claim 3 wherein:

a hollow is formed to store excess liquid sealant in the bottom of the outermost periphery of the circular groove.

* * * * *

UNITED STATES PATENT AND TRADEMARK OFFICE

CERTIFICATE OF CORRECTION

PATENT NO. : 6,672,293 B1 
DATED : January 6, 2004
INVENTOR(S) : Hisashi Yokoyama, Yasuhiko Kato and Takeshi Ikai It is certified that error appears in the above-identified patent and that said Letters Patent is hereby corrected as shown below:

Drawings,
Please replace Figs. 2, 3 and 4 with the attached Figs. 2, 3 and 4.

Signed and Sealed this

Tenth Day of May, 2005

JON W. DUDAS
*Director of the United States Patent and Trademark Office*

(12) United States Patent
Yokoyama et al.

(10) Patent No.: US 6,672,293 B1
(45) Date of Patent: Jan. 6, 2004

(54) EXHAUST GAS RECIRCULATING VALVE DEVICE

(75) Inventors: Hisashi Yokoyama, Tokyo (JP); Yasuhiko Kato, Tokyo (JP); Takeshi Ikai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/937,360

(22) PCT Filed: Jan. 25, 2000

(86) PCT No.: PCT/JP00/00363

§ 371 (c)(1),
(2), (4) Date: Sep. 25, 2001

(87) PCT Pub. No.: WO01/55579

PCT Pub. Date: Aug. 2, 2001

(51) Int. Cl.[7] ..... F02B 47/08
(52) U.S. Cl. ..... 123/568.21; 251/129.11
(58) Field of Search ..... 123/568.21, 568.24, 123/568.23; 251/129.11; 277/427

(56) References Cited

U.S. PATENT DOCUMENTS

| | | | | |
|---|---|---|---|---|
| 4,782,811 A | | 11/1988 | Hewette et al. | 123/571 |
| 5,351,935 A | | 10/1994 | Miyoshi et al. | |
| 5,669,364 A | | 9/1997 | Everingham | 123/568 |
| 5,769,390 A | | 6/1998 | Ando | |
| 6,227,183 B1 | | 5/2001 | Miyoshi et al. | 123/568.23 |
| 6,378,838 B1 | * | 4/2002 | Brundisini | 251/129.04 |
| 6,453,891 B2 | * | 9/2002 | Kato et al. | 123/568.24 |

FOREIGN PATENT DOCUMENTS

| | | | |
|---|---|---|---|
| EP | 0 810 361 A1 | 12/1997 | |
| EP | 1 156 246 A1 | 11/2001 | |
| JP | 57-92042 | 11/1955 | |
| JP | 5-106520 | 4/1993 | F02M/25/07 |
| JP | 6-18966 | 3/1994 | F16K/1/48 |
| JP | 8-4932 | 1/1996 | F16K/31/04 |
| JP | 8-44432 | 2/1996 | G05D/7/06 |
| JP | 8-68324 | 3/1996 | F01P/5/10 |

* cited by examiner

*Primary Examiner*—Mahmoud Gimie
(74) *Attorney, Agent, or Firm*—Sughrue Mion, PLLC

(57) ABSTRACT

The exhaust gas recirculation valve device of the present invention is provided with a motor main body 20 which drives a valve 8 by a valve rod 6 in direction of opening or closing, and a motor holder 21 which covers the lower opening of the motor main body 20. A circular groove 50 is formed on one of the upper section of the motor holder 21 and the lower opening of the motor main body 20 and a protrusion 60 which fits into the circular groove 50 is formed on the other of the upper section of the motor holder 21 and the lower opening of the motor main body 20. A liquid sealant layer 70 is disposed between upper face 61 which is the top of the protrusion and the lower face 50*a* which is the bottom of the circular groove 50 facing the upper face 61.

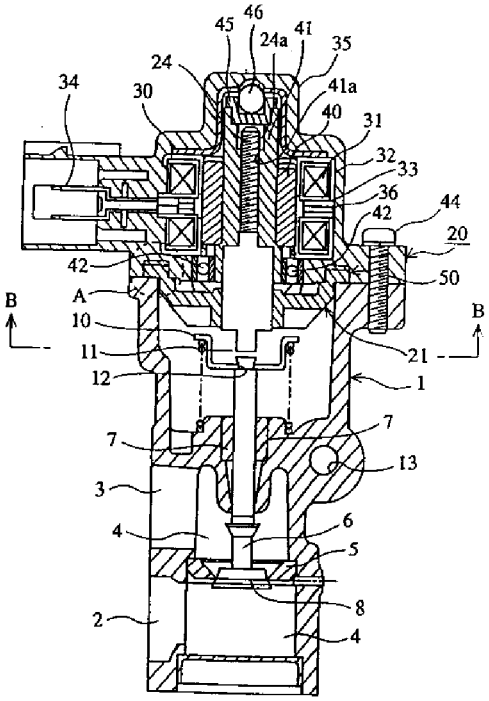

7 Claims, 5 Drawing Sheets